US011918056B2

(12) United States Patent
Shaughnessy et al.

(10) Patent No.: US 11,918,056 B2
(45) Date of Patent: Mar. 5, 2024

(54) MALE GARMENT

(71) Applicant: 0912139 B.C. LTD., Vancouver (CA)

(72) Inventors: Nora Shaughnessy, North Vancouver (CA); Desmond Price, North Vancouver (CA); Dustin Bigney, North Vancouver (CA)

(73) Assignee: Pakage Apparel Inc., Vancouver (CA)

( * ) Notice: Subject to any disclaimer, the term of this patent is extended or adjusted under 35 U.S.C. 154(b) by 0 days.

(21) Appl. No.: 17/651,229

(22) Filed: Feb. 15, 2022

(65) Prior Publication Data

US 2022/0167686 A1 Jun. 2, 2022

Related U.S. Application Data

(63) Continuation of application No. 17/184,361, filed on Feb. 24, 2021, now Pat. No. 11,272,744.

(60) Provisional application No. 62/981,371, filed on Feb. 25, 2020.

(51) Int. Cl.
*A41B 9/02* (2006.01)
*A41B 9/00* (2006.01)

(52) U.S. Cl.
CPC ..... *A41B 9/001* (2013.01); *A41B 9/004* (2013.01); *A41B 9/023* (2013.01)

(58) Field of Classification Search
CPC ..... A41B 9/001; A41B 9/004; A41B 9/023
See application file for complete search history.

(56) References Cited

U.S. PATENT DOCUMENTS

| | | | | |
|---|---|---|---|---|
| 2,457,260 | A | 12/1948 | Morris | |
| 4,805,243 | A * | 2/1989 | Gibbens | A41D 1/084 2/253 |
| 5,749,101 | A * | 5/1998 | Breindel | A41D 13/0575 2/403 |
| 8,230,526 | B2 | 7/2012 | Holland et al. | |
| 10,092,042 | B2 * | 10/2018 | Samuel | A41B 9/12 |
| 2005/0235399 | A1 | 10/2005 | Kang | |
| 2012/0266361 | A1 * | 10/2012 | Maier | A41D 1/084 2/227 |
| 2015/0074885 | A1 * | 3/2015 | De Soto, II | A41D 1/084 2/466 |
| 2016/0278438 | A1 * | 9/2016 | Polidan | A41B 9/02 |
| 2017/0258144 | A1 * | 9/2017 | Bardini | A41B 9/001 |
| 2019/0343195 | A1 * | 11/2019 | Stewart | A41D 1/088 |

FOREIGN PATENT DOCUMENTS

| | | | | |
|---|---|---|---|---|
| FR | 2841439 | A1 | 1/2004 | |
| JP | 3092271 | U | 3/2003 | |
| KR | 19990004255 | U | 1/1999 | |
| RU | 2368292 | C1 | 9/2009 | |
| WO | WO-2006023007 | A2 * | 3/2006 | A41D 1/084 |

* cited by examiner

*Primary Examiner* — Richale L Quinn
(74) *Attorney, Agent, or Firm* — Stoel Rives LLP

(57) ABSTRACT

There is described a male garment having a body including a front portion and leg openings for a wearer's legs. A resiliently elastic stretch panel is attached to an interior of the body and includes an opening for receiving therethrough the wearer's genitalia. A pouch is defined between the stretch panel and the front portion for receiving therein the wearer's genitalia. A padded member is attached to the interior of the body for cushioning one or more areas of the wearer, such as their crotch and buttocks.

23 Claims, 10 Drawing Sheets

MALE GARMENT

TECHNICAL FIELD

The present disclosure relates to a male garment such as a pair of undershorts.

BACKGROUND TO THE DISCLOSURE

Next-to-skin clothing for men should comfortably accommodate the wearer's genitalia. Uncomfortable pressure and/or chafing of the genital area are common problems with existing male undergarments, especially for wearers who are performing sports or other physical activities.

There is therefore a need for garments for men and boys that are more comfortable to wear than many existing garments, having regard especially to the genital area.

SUMMARY OF THE DISCLOSURE

According to a first aspect of the disclosure, there is provided a male garment comprising: a body including a front portion and leg openings for a wearer's legs; a resiliently elastic stretch panel attached to an interior of the body and comprising an opening for receiving therethrough the wearer's genitalia; a pouch defined between the stretch panel and the front portion for receiving therein the wearer's genitalia; and a padded member attached to the interior of the body for cushioning one or more areas of the wearer.

The one or more areas of the wearer may comprise one or more of the wearer's crotch and buttocks. The one or more areas may additionally comprise the wearer's genitalia.

The front portion may comprise a front panel and a rear panel, wherein a space is defined between the front panel and the rear panel.

The padded member may extend into the space defined between the front panel and the rear panel.

The front portion may comprise a dart seam to assist in defining the pouch.

The padded member may be attached to the dart seam.

The padded member may be shaped to resemble a shape of a bicycle saddle.

The padded member may comprise polyester.

The padded member may comprise an antimicrobial material.

The padded member may comprise a chamois.

The body may further comprise a gusset including a front gusset seam and a rear gusset seam. The front portion and the stretch panel may be attached to the gusset along the front gusset seam.

The gusset may comprise a mesh fabric for improving breathability of the garment.

The padded member may be attached to the stretch panel along the front gusset seam.

The body may further comprise a rear portion interconnected to the front portion via the gusset.

The padded member may be attached to an interior of the rear portion and may extend over a portion of the rear portion and over a portion of the gusset.

The stretch panel may be attached to the front portion at top and bottom locations.

When unstretched, the stretch panel may have a top-to-bottom length that is smaller than a distance separating the top and bottom locations as measured along the front portion.

The top location may be a portion of a waistband seam of the garment.

The bottom location may be a portion of a front gusset seam of a gusset of the garment.

The stretch panel may be attached to the front portion at left and right locations.

When unstretched, the stretch panel may have a left-to-right width that is smaller than a distance separating the left and right locations as measured along the front portion.

The stretch panel may comprise one or more fabrics with one or more asymmetric stretch characteristics such that the stretch panel stretches more easily in a top-to-bottom direction than in a left-to-right direction.

The opening may comprise a rounded bottom edge and opposing lateral edges.

The stretch panel may comprise a fabric having a stretch of at least 30%.

The garment may be a pair of undershorts.

The stretch panel may comprise a fabric that is different from a fabric of the body.

The stretch panel may comprise a pair of top edges, each top edge having first and second ends, the first ends defining upper corners of the stretch panel. When the stretch panel is unstretched, the top edges may extend downwardly from the first ends to the second ends.

The stretch panel may be attached to the front portion along the top edges of the stretch panel such that, when attached to the front portion, the stretch panel is tensioned.

According to a further aspect of the disclosure, there is provided a method of making a male garment, the male garment comprising: a body including a front portion and leg openings for a wearer's legs; a resiliently elastic stretch panel attached to an interior of the body and comprising an opening for receiving therethrough the wearer's genitalia; and a pouch defined between the stretch panel and the front portion for receiving therein the wearer's genitalia, wherein the method comprises attaching a padded member to an interior of the body for cushioning one or more areas of the wearer.

The one or more areas of the wearer may comprise one or more of the wearer's crotch and buttocks. The one or more areas may additionally comprise the wearer's genitalia.

The front portion may comprise a front panel and a rear panel, wherein a space is defined between the front panel and the rear panel, and attaching the padded member to the interior of the body may comprise inserting a portion of the padded member into the space defined between the front panel and the rear panel.

Attaching the padded member to the interior of the body may comprise attaching a bottom of the stretch panel to the padded member.

The garment may further comprise a gusset having a front seam and a rear seam, and attaching the bottom of the stretch panel to the padded member may comprise stitching the bottom of the stretch panel to the padded member along the front seam of the gusset.

BRIEF DESCRIPTION OF THE DRAWINGS

Embodiments of the disclosure will now be described in detail in conjunction with the accompanying drawings of which.

DETAILED DESCRIPTION

The present disclosure seeks to provide an improved male garment. While various embodiments of the disclosure are described below, the disclosure is not limited to these embodiments, and variations of these embodiments may fall within the scope of the disclosure which is to be limited only by the appended claims.

The word "a" or "an" when used in conjunction with the term "comprising" or "including" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

The terms "coupled", "coupling" or "connected" as used herein can have several different meanings depending on the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through one or more intermediate elements or devices via an electrical element, electrical signal or a mechanical element depending on the particular context. The term "and/or" herein when used in association with a list of items means any one or more of the items comprising that list.

As used herein, a reference to "about" or "approximately" a number or to being "substantially" equal to a number means being within +/−10% of that number.

Generally, there are described next-to-skin male garments that include a pouch for receiving the wearer's genitalia. Male garments according to the present disclosure additionally include a padded member, such as a chamois, for cushioning the wearer's one or more areas of the wearer, such as the wearer's crotch and buttocks. Such garments may provide enhanced comfort for the wearer, and may be particularly suited for wearers intending to perform cycling-related sports.

Figure 1:
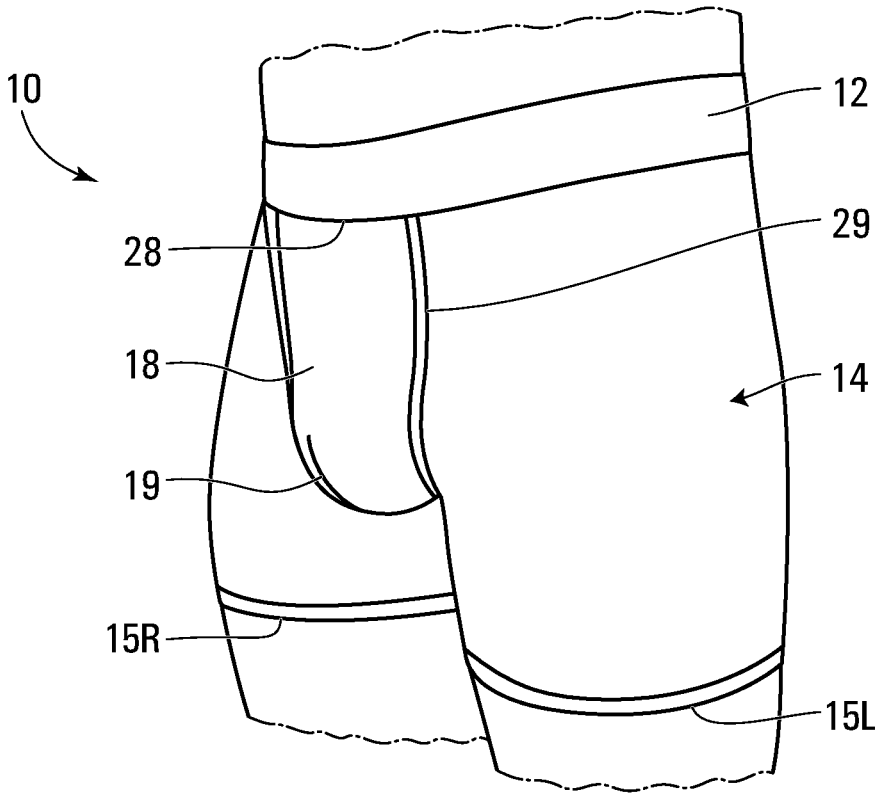
FIG. 1 is a front perspective view of a pair of undershorts according to an embodiment of the disclosure.
Figure 2:
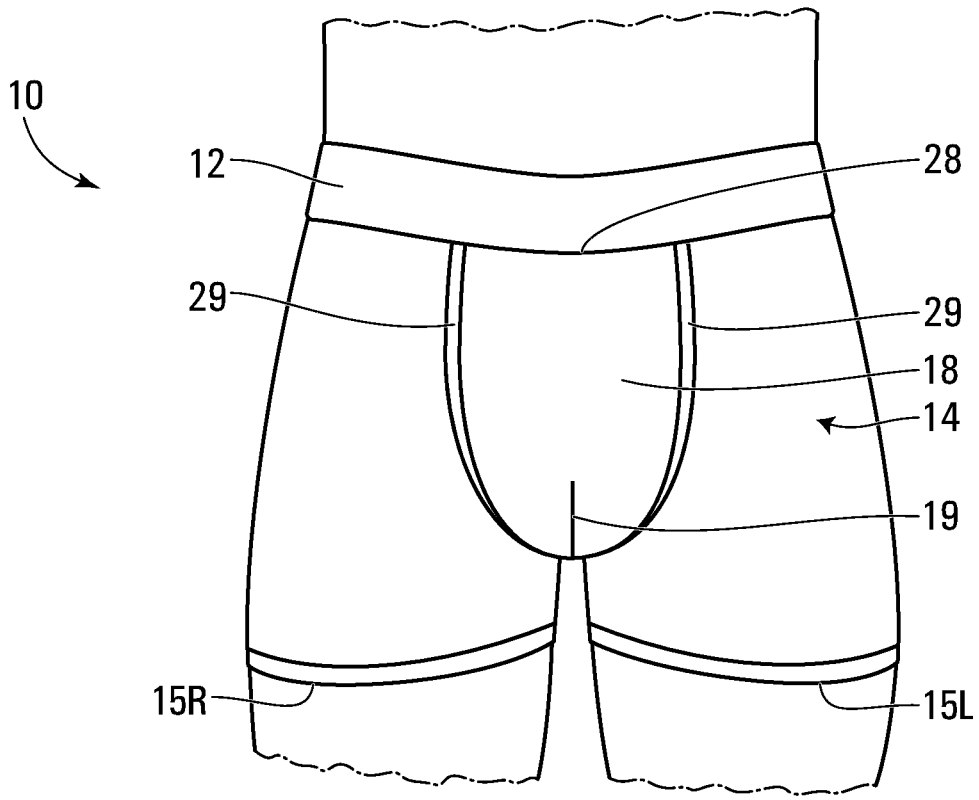
FIG. 2 is a front view of the undershorts of FIG. 1.

FIGS. 1 and 2 show undershorts 10 according to an example embodiment of the disclosure. Undershorts 10 have an elastic waistband 12 supporting a fabric body 14. Body 14 extends to leg openings 15R and 15L (collectively "leg openings 15"). A front portion 18 of body 14 is shaped to include additional fabric so that front portion 18 is not pulled tightly against a wearer's body. As described below, front portion 18 forms the front part of a three-dimensional pouch 20 that receives and gently supports the wearer's genitalia. In the illustrated embodiment, front portion 18 includes a front seam (which may also be referred to as a dart seam 19) that extends part way along front portion 18 from the crotch of undershorts 10 toward waistband 12. Dart seam 19 enables additional fabric to be provided in front portion 18. This in turn enables volume to be added to pouch 20. A tunnel opening or other suitable opening may optionally be provided in front portion 18 to permit the wearer to urinate conveniently.

Figure 3:
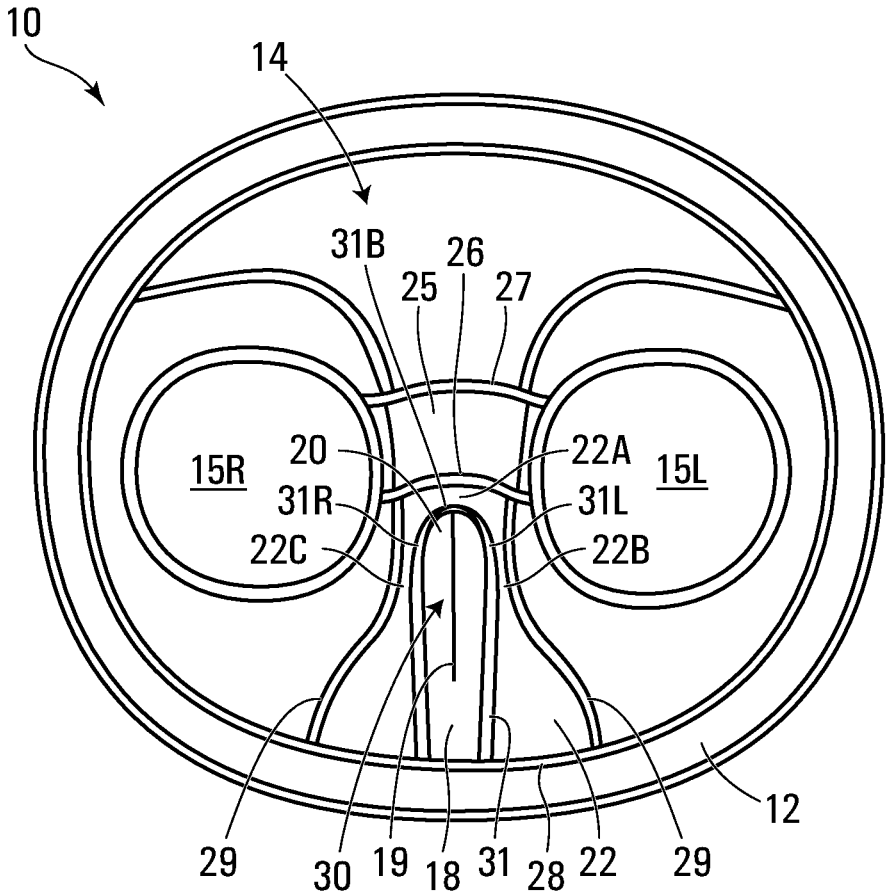
FIG. 3 is a top view of the interior of the undershorts of FIG. 1.

As shown in FIG. 3, undershorts 10 have a construction that includes a gusset 25 joined by a front seam 26 and a rear seam 27 to the front and rear sides of body 14, respectively. Gusset 25 may be referred to an arc panel or moisture panel. Undershorts 10 further include a stretch panel 22 that extends between waistband 12 and gusset 25.

In the illustrated embodiment, a lower end of stretch panel 22 is attached at front seam 26 and an upper end of stretch panel 22 is attached at a waistband seam 28 joining waistband 12 to body 14. Lateral edges of stretch panel 22 are joined to front portion 18 of body 14 along seams 29 on either side of front portion 18.

When undershorts 10 are held open as shown for example in FIG. 3 with waistband 12 under gentle tension and body 14 hanging freely, stretch panel 22 is contracted and pulled away from front portion 18 so as to provide a three-dimensional pouch 20 between stretch panel 22 and front portion 18. The bias of stretch panel 22 to be contracted more than front portion 18 helps to cause an opening 30 (described below) to be held open. Pouch 20 and opening 30 may be self-aligning with the penis and scrotum of a wearer as the wearer inserts his legs through leg openings 15.

Stretch panel 22 includes opening 30 to receive a wearer's genitalia. In the illustrated embodiment, opening 30 is U-shaped and has a softly-bound edge 31. A soft thread is preferably used in any stitching to bind edge 31. Alternatively, stretch panel 22 may be shaped such that side portions 31L and 31R of edge 31 become closer together near waistband 12 such that opening 30 is more tear-drop shaped. In yet further embodiments, the upper parts of side portions 31L and 31R of edge 31 may be adjacent each other, or joined together such that opening 30 has an oval or elliptical shape (not shown). Regardless of the particular shape of opening 30, stretch panel 22 is configured to define opening 30 and to provide support around and underneath the scrotum of the wearer in order to comfortably position the wearer's genitalia forward into pouch 20.

As can be seen in FIG. 3, holding waistband 12 of undershorts 10 open as one would do to put undershorts 10 on naturally causes pouch 20 to be open to receive the wearer's genitalia which can drop into place in pouch 20 through opening 30 as undershorts 10 are put on. In other words, when undershorts 10 are held by a man so as to be in a ready-to-wear position (e.g. held in mid-air by waistband 12), the weight of undershorts 10 holds stretch panel 22 such that opening 30 is open and clearly defined. The man's genitalia are thus naturally guided through opening 30 and positioned forward into pouch 20 as a result of this bias. As undershorts 10 are pulled on, stretch panel 20 stretches. This bias prevents the man's genitalia from falling out of pouch 20 in use, such as during physical activity and other movement.

It can be seen that side portions 31L and 31R of edge 31 and bottom portion 31B of edge 31 are all free edges that are spaced apart from the seams at which stretch panel 22 is attached to body 14, and that front portion 18 is spaced away from these edges in the forward direction. Bottom portion 31B is preferably curved.

Side portions 31L and 31R of edge 31 are spaced apart from one another by a gap to receive the wearer's genitalia. In some embodiments, the gap has a width of 2 cm or more at a location just above bottom portion 31B. In the illustrated embodiment, side portions 31L and 31R of edge 31 are generally straight.

Stretch panel 22 may be made of a two-way or four-way stretch material such that, when undershorts 10 are being worn, stretch panel 22 is under gentle tension. This causes stretch panel 22 to be held gently without sagging against the wearer's body in the perineal area and in the area adjacent the wearer's inner upper thighs. Stretch panel 22 is preferably made of or faced with a soft fabric that is comfortable against a wearer's skin. Stretch panel 22 is preferably made of a breathable fabric.

When undershorts 10 are being worn, stretch panel 22 may extend between the wearer's genitalia and the inner parts of the wearer's upper thighs, thereby reducing or avoiding entirely chafing between the wearer's genitalia and thighs. Similarly, stretch panel 22 may extend upwardly from underneath between the wearer's genitalia and the wearer's perineal area, thereby reducing or avoiding entirely chafing between the wearer's genitalia and perineal area. Preferably, front seam 26 is positioned forward of gusset 25 such that the bottom portion of stretch panel 22 is located forward of the perineum of a wearer.

Figure 4:
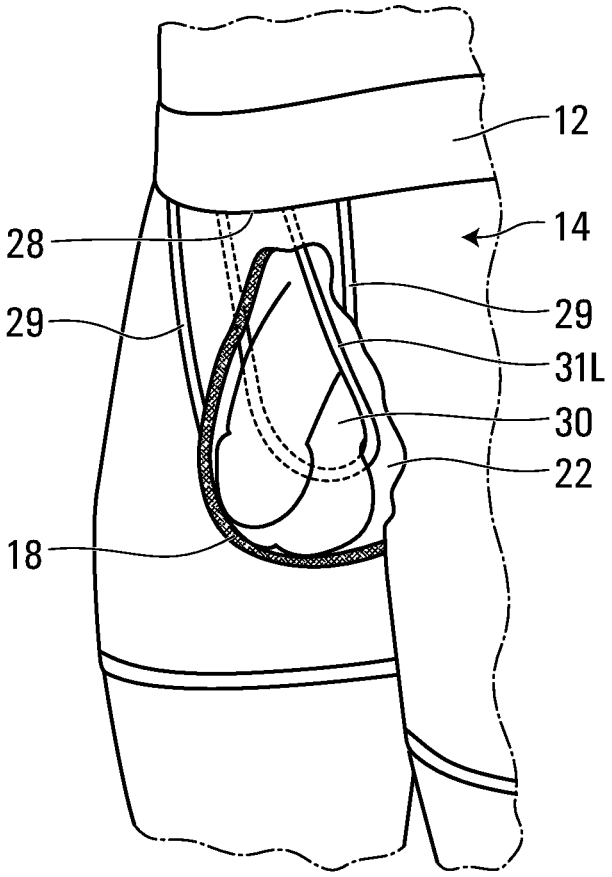
FIG. 4 is a cross-sectional view of the undershorts of FIG. 1, being worn and showing the wearer's genitalia supported in a pouch.

FIG. 4 shows how, when undershorts 10 are being worn, a wearer's genitalia pass though opening 30 over an upright portion 22A of stretch panel 22 that lies directly beneath the wearer's genitalia. Portion 22A of stretch panel 22 protects the underside of the wearer's genitalia from chafing. The edge portion 31L along the bottom of opening 30 is gently urged upward by the elastic nature of stretch panel 22 to gently support the wearer's genitalia from below. Side portions 22B and 22C of stretch panel 22 help to suspend edge portion 31L. If edge portion 31L is pressed down, then the elasticity of stretch panel 22, particularly side portions 22B and 22C, tend to pull edge portion 31L upward toward its original position. In the illustrated embodiment, side portions 22B and 22C are generally rectangular.

Edge portions 31R and 31L gently contain the sides of the wearer's genitalia and thereby help to counteract swinging from side-to-side during activity. In FIG. 4, it can also be seen that stretch panel 22 provides a soft layer between the wearer's genitalia and upper thighs.

In the illustrated embodiment, stretch panel 22 is generally rectangular. The length of attachment of stretch panel 22 at seams 26 and 27 is equal to within ±10% or ±15%, for example. With undershorts 10 lying flat, face up, seams 29 are generally straight and generally perpendicular to waistband 12. The ratio of height to width of stretch panel 22 in some embodiments is approximately about 1½:1 to about 2:1. For example, in an example embodiment, stretch panel 22 has an un-stretched height of about 17 cm and an un-stretched width of about 10 cm.

In some embodiments, the material of stretch panel 22 has asymmetrical stretch (e.g. the coefficient of elasticity of the material has a first value in a first direction in the plane of the material and a second value different from the first value in a second direction at right angles to the first direction in the plane of the material). The material may be oriented such that it is easier to stretch the material of stretch panel 22 in a direction parallel to waistband 12 than it is to stretch the material in a direction perpendicular to waistband 12.

Various materials may be used for stretch panel 22. For example, stretch panel 22 may comprise an elasticized fabric. In one example embodiment, the fabric comprises a polyester-Spandex™ blend, and may further include an antimicrobial agent. In one example embodiment, the fabric comprises a blend of about 78% polyester, about 14% Spandex™, and about 8% XT2® polyester. XT2® may prevent bacteria from forming during activity, and may therefore assist in reducing odour generated during activity. According to some embodiments, stretch panel 22 comprises a polyester mesh fabric.

The amount of stretch of a fabric may be measured in various ways. The fabric stretch may be measured by taking a strip of material that is 30-40 cm long and 20 cm wide when taught but un-stretched, anchoring one end of the strip, pulling the other end of the strip so that the material stretches and becomes elongated, and determining the maximum stretched length after which the strip will no longer return to its original length in the taught but un-stretched condition. The ratio of the maximum stretched length minus the taught but un-stretched length to the taught but un-stretched length is the fabric stretch. For example, if the strip has a taught but un-stretched length of 25 cm and a maximum stretched length of 50 cm, then the fabric stretch is (50−25)/25=100%. In some embodiments, the material of stretch panel 22 has a stretch of 30% or more. In some embodiments, the material of stretch panel 22 has a stretch of at least 70% or at least 75%.

Stretch panel 22 may be pre-stretched relative to front portion 18 while it is being assembled to front portion 18 of body 14. Thus, during assembly, stretch panel 22 is substantially stretched, while front portion 18 of body 14 is not stretched or is stretched less than stretch panel 22. In some embodiments, the material of stretch panel 22 is stretched by at least 50%, 55%, or 60% while stretch panel 22 is being sewn in place. In an example embodiment, stretch panel 22 has a stretch of 100% and is stretched by 60% while at least the final seams which hold it in place are being sewn.

Figure 5:
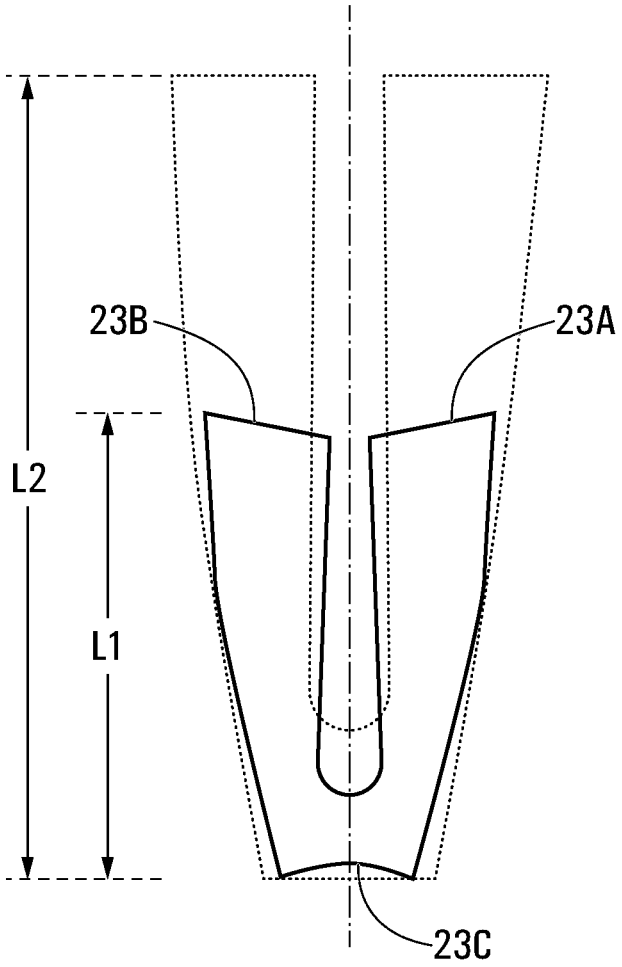
FIG. 5 is a front view of a stretch panel in an unstretched state, according to an embodiment of the disclosure.

FIG. 5 shows stretch panel 22 'as cut' according to a pattern in solid outlines and 'as stretched' for assembly to front portion 18 in dashed outlines. In this embodiment, top edges 23A and 23B of stretch panel 22 along which stretch panel 22 is attached at a seam parallel to waistband 12 are angled. In the illustrated embodiment, bottom edge 23C is also cut so that it is indented at the centerline. Thus, when unstretched, the cut-out material for stretch panel 22 is shorter in its vertical dimension along vertical lines extending along the edges of opening 30 than it is farther away from its centerline. As a result of the angling of edges 23A and 23B, and the indenting of bottom edge 23C, stretch panel 22 is stretched more for assembly in its portions along edge portions 31R and 31L than it is stretched in its portions closer to the sides where it is attached along seams 29. This causes the tension in stretch panel 22 when undershorts 10 are being worn or suspended to be put on to be somewhat greater along edge portions 31R and 31L than in other parts of stretch panel 22. This gradient in tension helps to better support edge portion 31B and to hold opening 30 open when undershorts 10 are being held to be put on.

As shown in dotted outline in FIG. 5, the material from stretch panel 22 may be stretched from an un-stretched length L1 to a stretched length L2 while top edges 23A and 23B and bottom edge 23C are attached along parallel seams 26 and 28 and side edges of the stretch panel 22 are attached along seams 29, for example by sewing.

After assembly, stretch panel 22 can contract. This gathers the material of front portion 18 and helps to form pouch 20 to have a three-dimensional volume open to receive a wearer's genitalia even when undershorts 10 are being suspended from waistband 12 in preparation for being put on.

The configuration of stitching used to affix stretch panel 22 to body 14 preferably permits stretching along the length of the seams. For example, in the illustrated embodiment, seams 26, 28, and 29 may be stitched using a combination of stitch pattern and/or thread that permits stretching along the lengths of seams 26, 28, and 29.

In some embodiments, stretch panel 22 is stretched in length only (i.e. in a direction perpendicular to waistband 12) as it is being attached to front portion 18 during manufacture. In some embodiments, stretch panel 22 is stretched in both width and length (four-way stretch) relative to front portion 18 as it is being attached to front portion 18 during manufacture. Thus, in its relaxed, un-stretched configuration, stretch panel 22 both pulls side edges of front portion 18 toward one another at seams 29 and pulls top and bottom edges of front portion 18 toward one another at seams 26 and 28. This builds volume in pouch 20 especially when taken in combination with the shaping of front portion 18 (e.g. by dart seam 19) which makes front portion 18 non-flat.

In some embodiments, a length measured along material of the front portion 18 from seam 26 to waistband 12 exceeds a length measured along the fabric of stretch panel 22, when un-stretched by at least 50%. In some embodiments, a length measured along material of the front portion 18 side-to-side at the level of bottom portion 31B from seam 28 to seam 29 exceeds a length measured along the fabric of stretch panel 22, when un-stretched between the same seams by 10 to 15% or more.

In some embodiments, the shaping of front portion 18 is such that with stretch panel 22 held horizontally under just enough tension such that stretch panel 22 is generally planar with front portion 18 hanging below stretch panel 22, the center part of front portion 18 hangs well below the plane of stretch panel 22. In some embodiments, the center part of front portion 18 hangs below the plane of stretch panel 22 by a distance of 3 cm or more when undershorts 10 are held in this test configuration.

Like all clothing, undershorts 10 may be made to fit different sizes of men and boys and may be made from different fabrics to suit different personal preferences and price points. Thus, individual dimensions are not critical.

In some embodiments, the distance A along stretch panel 22 from the point at which it joins body 14 to the lowest point along the edge of opening 30 is at least 2 cm. In some embodiments, this distance is in the range of about 2 cm to about 3 cm. In some embodiments, the horizontal distance B between opposed edges of opening 30 when undershorts 10 or other garments according to some example embodiments are not being worn but are being suspended as shown for example in FIG. 3 is in the range of about 3 cm to about 6 cm. In some embodiments, the horizontal distance C along stretch panel 22 from the point at which it joins body 14 (e.g. at seam 29) to the edge portion 31R or 31L of opening 30 just above bottom portion 31B is at least 2 cm. In some embodiments, this distance is in the range of about 2 cm to about 5 cm. In some embodiments, the distance D along the fabric in the center of front portion of body 18 from the lower edge of waistband 12 to the point where stretch panel 22 attaches to body 14 (e.g. seam 26) is at least 15 cm. In some embodiments, this distance is in the range of about 15 cm to about 25 cm.

It is not mandatory that stretch panel 22 be free from openings. In some embodiments, stretch panel 22 comprises a continuous layer of material with no openings other than opening 30. In other embodiments, stretch panel 22 may have one or more openings around the periphery of opening 30.

It is not mandatory that the material of stretch panel 22 be different from the material(s) of the rest of body 14. In some embodiments different fabrics are used for stretch panel 22 and for front portion 18 of body 14.

Stretch panel 22 may incorporate openings into pouch 20 that are of various shapes. Example openings are U-shaped (as described above), oval, elliptical, teardrop-shaped, and the like.

Stretch panel 22 may optionally be formed from a plurality of pieces of fabric seamed together. For example, stretch panel 22 may be formed from three pieces of fabric, two of which extend vertically along sides of opening 30 and one of which extends transversely across the bottom of opening 30.

It is not mandatory that the garment include a body that covers a wearer's buttocks. In some embodiments, constructions as described herein are applied to athletic supporters (jock straps). In general, a pouch as described herein may be embodied in various types of men's garments, particularly in a mid-section of a front wall of men's garments to be worn around a man's torso.

Figure 6:
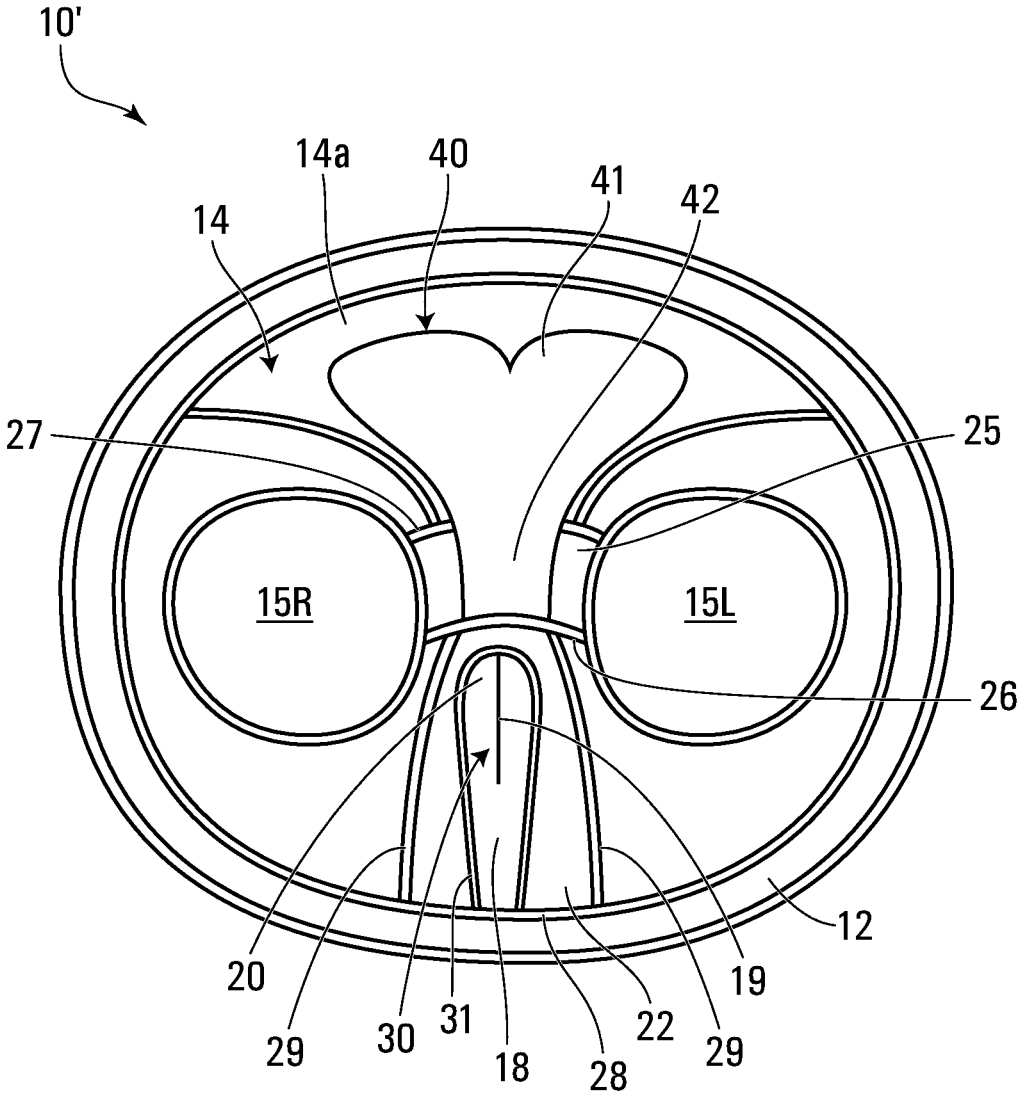
FIG. 6 is a top view of the interior of a pair of undershorts according to an embodiment of the disclosure.

Turning to FIG. 6, there is now shown a pair of undershorts 10' according to further embodiments of the disclosure. Undershorts 10' are similar to undershorts 10, and like features are labelled using like reference numbers. In addition to including a similar stretch panel 22 and pouch 30, undershorts 10' further comprise a padded member 40 for providing further comfort and support to the wearer.

As can be seen in FIG. 6, padded member 40 is provided on an interior of body 14. Padded member 40, which may also be referred to as a chamois, comprises padding shaped to provide cushioning and support to the wearer's crotch and buttocks during physical activity, especially cycling. Padded member 40 includes a rear end 41 that is attached to a rear panel or a rear portion 14 a of body 14. Rear end 41 of padded member 40 is shaped to provide cushioning for the wearer's sit bones and adjacent areas of the wearer's buttocks when the wearer is wearing undershorts 10' and is sitting, for example, on a bicycle saddle.

Padded member 40 further includes a narrower middle portion 42 extending away from rear end 41 and over gusset 25. Middle portion 42 is shaped to provide cushioning for the wearer's crotch. A front end 43 (not shown in FIG. 6) of padded member 40 extends into a pocket or space 21 provided within front portion 18 of body 14, as described in further detail below with reference to FIG. 7.

Figure 7:
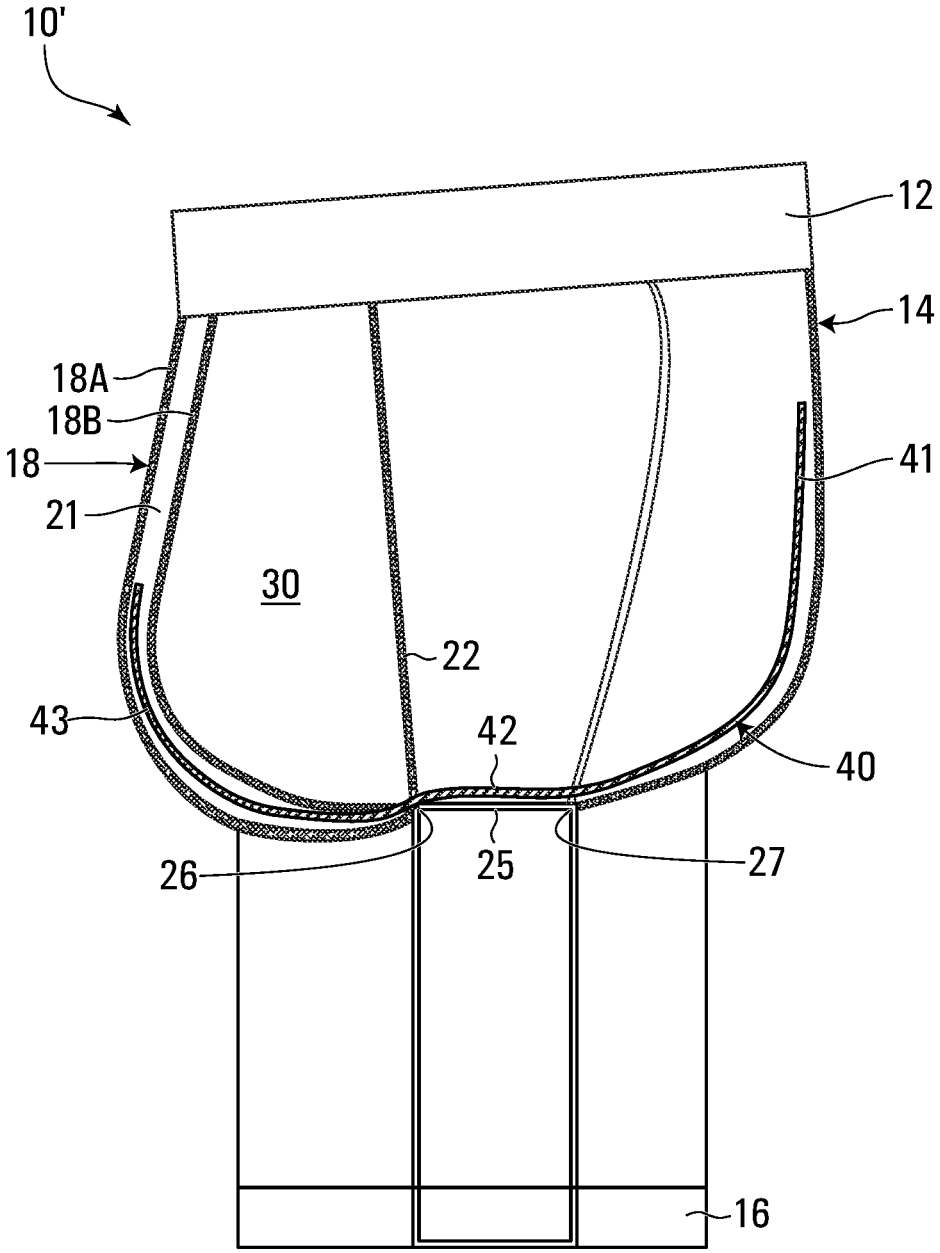
FIG. 7 is a cross-sectional view of the undershorts of FIG. 6.

Turning to FIG. 7, there is a shown a cross-sectional view of undershorts 10' with padded member 40 attached to an interior thereof. Rear end 41 of padded member 40 is shown attached to rear portion 14*a* of body 14. Middle portion 42 of padded member 40 extends over rear seam 27 of gusset 25.

As can be further seen from the illustrated embodiment, front portion 18 comprises a front panel 18*a* and a rear panel 18*b*, with a space 21 defined between front panel 18*a* and rear panel 18*b*. Front end 43 of padded member 40 extends into space 21 defined between front panel 18*a* and rear panel 18*b* of front portion 18. This may ensure, for example, that front end 43 does not protrude into pocket 30 and therefore does not interfere with the genitalia of the wearer when undershorts 10' are being worn. Front end 43 of padded member 40 is attached to dart seam 19 (not shown in FIG. 7). Attaching front end 43 of padded member 40 to dart seam 19 may avoid movement/folding of padded member 40. Padded member 40 may be attached to other areas of front portion 18, and not necessarily dart seam 19. According to some embodiments, front end 43 of padded member 40 may extend further within space 21, to act as a modesty cover.

When constructing undershorts 10', front end 43 of padded member 40 is first inserted into space 21 provided between front panel 18*a* and rear panel 18*b* of front portion 18. Front end 43 is then stitched to dart seam 19. Subsequently, in order to secure padded member 40 to the interior of body 14, padded member 40 is stitched to body 14 at front seam 26 of gusset 25. Thus, the bottom portion of stretch panel 22 is stitched to body 14 at front seam 26, with padded member 40 provided between the bottom portion of stretch panel 22 and body 14. Rear portion 41 of padded member 40 is then stitched to rear portion 14*a* of body 14. Attaching padded member 40 between stretch panel 22 and front seam 26 of gusset 25 enables stretch panel 22 to continue to function properly as intended, without padded member 40 interfering with the function of stretch panel 22. Furthermore, padded member 40 provides some protection to the interior of undershorts 10'.

Thus, by inserting front end 43 of padded member 40 into space 21, padded member 40 may provide a protective or cushioning function for areas of the wearer, such as the wearer's buttocks, crotch, and genitalia, while still allowing for pouch 30 to be formed via stretch panel 22 and front portion 18. Accordingly, the genitalia may be supported away from a seat (such as a bicycle saddle), thus reducing compression of the genitalia during use of undershorts 10'.

Padded member 40 enables undershorts 10' to be particularly useful when the wearer is engaging in cycling or similar activities. In particular, padded member 40 provides cushioning for the wearer's crotch (which may include, for example, the wearer's perennial area and genitalia) and buttocks (which may include, for example, the wearer's sit bones and any other adjacent areas of the wearer's buttocks) when sitting on a bicycle saddle, especially for extended periods of time.

Padded member 40 comprises polyester and an antimicrobial agent to reduce the risk of bacterial growth on undershorts 10'. In addition, certain areas of undershorts 10' are provided with a mesh fabric, to improve the breathability of undershorts 10' during high-output activities such as cycling. In particular, according to some embodiments, gusset 25, stretch panel 22, front panel 18*a*, and a top 17 of rear portion 14*a* of body 14 (shown in FIGS. 9 and 10) include a mesh fabric.

In addition to the inclusion of padded member 40, undershorts 10' comprise silicone beading on the interior of waistband 12 to provide additional grip to the wearer when undershorts 10' are being worn. Other forms of friction-enhancing surface treatment and/or patterning may be provided on waistband 12. Undershorts 10' additionally include elastic leg hems 16 that are larger than the leg hems of undershorts 10. Such larger leg hems may minimize movement of undershorts 10' relative to the wearer during physical activity. For example, according to some embodiments, an inseam of leg hems 16 may be from about 3 inches to about 29 inches.

Figure 8:
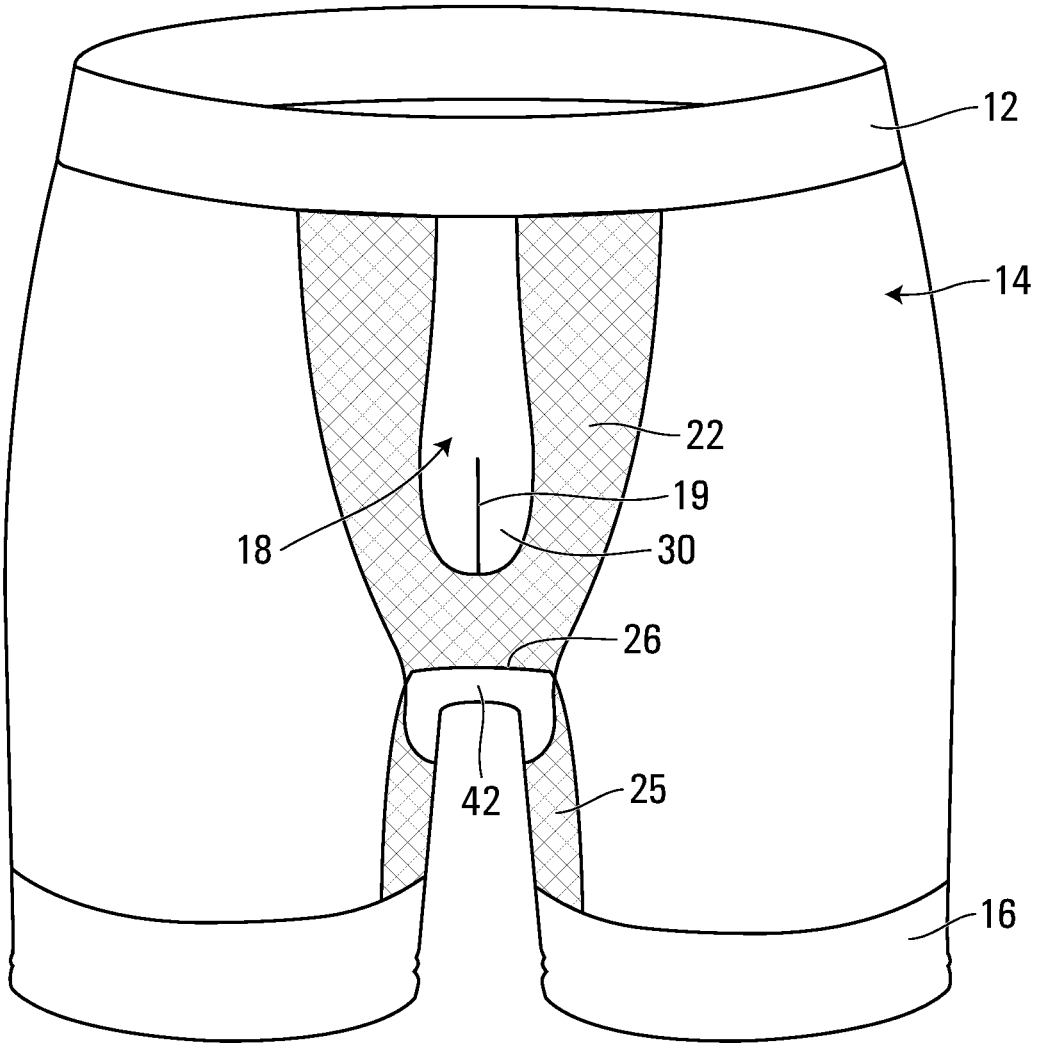
FIG. 8 is a front view of the interior of the undershorts of FIG. 6.
Figure 9:
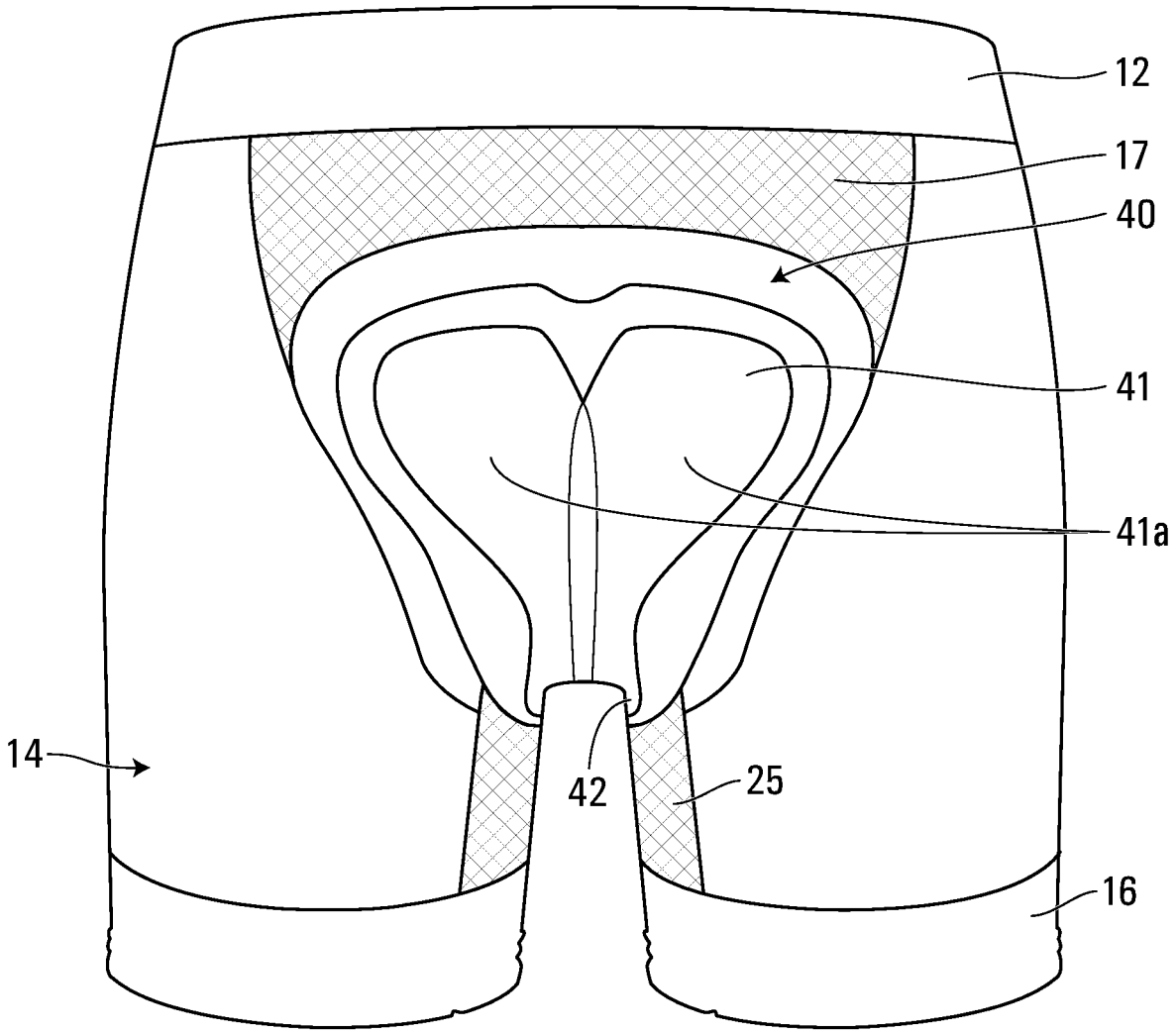
FIG. 9 is a rear view of the interior of the undershorts of FIG. 6.
Figure 10:
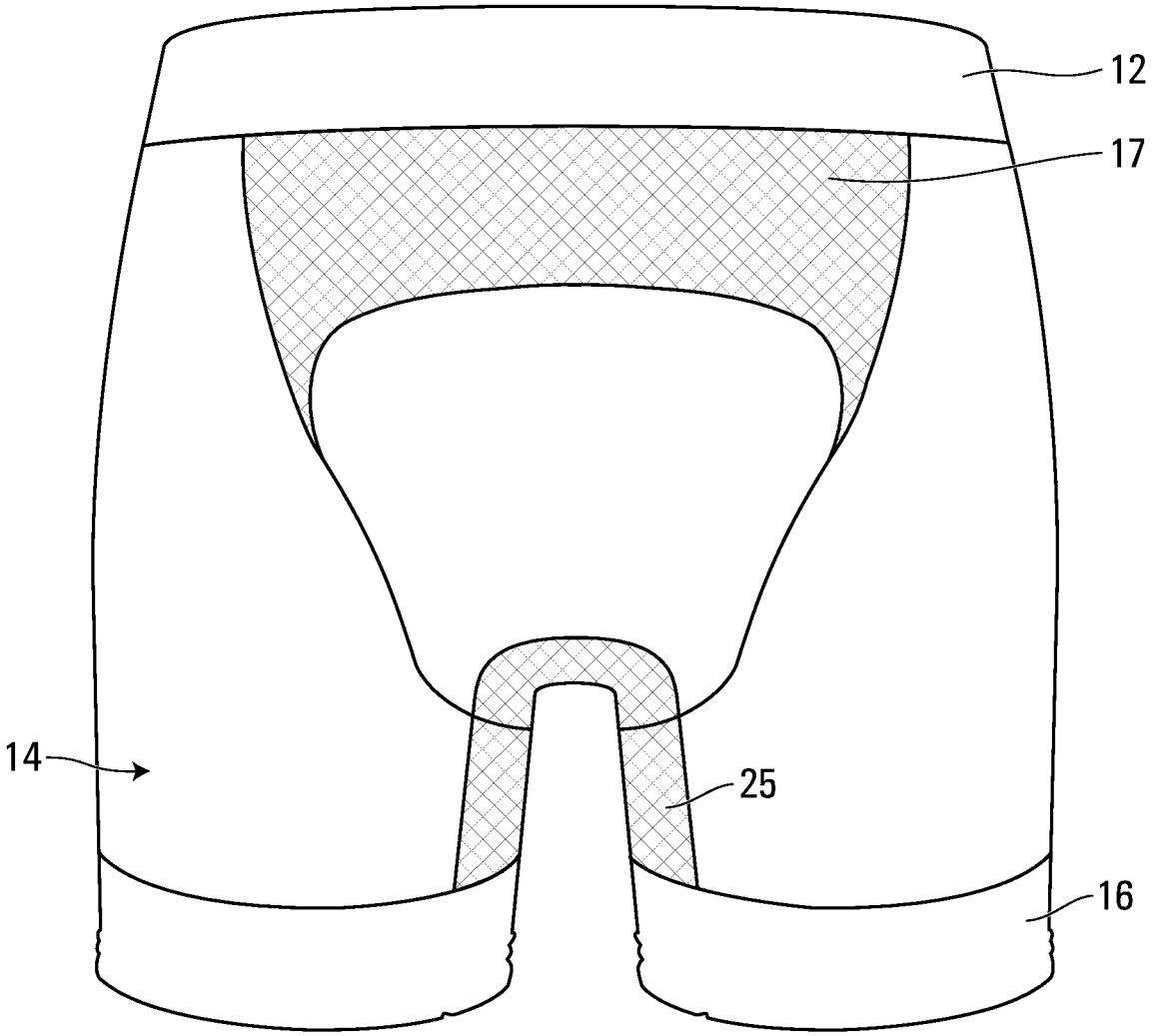
FIG. 10 is a rear view of the undershorts of FIG. 6.

FIG. 8 shows a front interior of undershorts 10'. Middle portion 42 of padded member 40 can be seen overlying gusset 25, and provides cushioning for the wearer's crotch. FIG. 9 shows a rear interior of undershorts 10'. Rear end 41 of padded member 40 includes areas 41*a* for providing cushioning to the wearer's buttocks. In particular, areas 41*a* are shaped to provide cushioning, for example, for the wearer's sit bones and adjacent areas when the user is sitting down, especially in a bicycle saddle. FIG. 10 shows a rear of undershorts 10', with top 17 of rear portion 14*a* of body 14 located above rear end 41 of padded member 40 and comprising mesh fabric.

While FIGS. 6-10 show padded member 40 comprising a single chamois, according to some embodiments undershorts 10' may comprise more than one padded member. For example, according to some embodiments, undershorts 10' may comprise multiple padded members located at specific locations on the interior of the body of the undershorts to provide cushioning in specific, predetermined locations.

Undershorts 10' enable a user, instead of wearing cycling-specific overshorts, to instead wear undershorts 10' to provide the desired cushioning to their crotch and buttocks. Normal, non-cycling-specific shorts may then be worn over undershorts 10'. Alternatively, according to some embodiments, undershorts 10' may be joined to a pair overshorts by a single waistband. Thus, both undershorts and overshorts may be integrally formed into a single item of clothing.

Embodiments of the disclosure may be applied to any next-to-skin, below-the-waist garment for men. For example, the principles discussed herein may be applied to shorts, swim suits, boarding shorts, briefs, boxer shorts, surf shorts, cycling shorts, unitards, long underwear, sports uniforms, athletic supporters, fighting shorts, pajamas, and other next-to-skin garments for males.

Except where otherwise indicated or necessarily implied, the description herein uses relative directional terms such as front, back, above, below, top, bottom, upper, lower, right, and left relative to a wearer wearing a garment as described and standing upright.

Where a component (e.g. a panel, seam, elastic, thread, opening, etc.) is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments.

While the disclosure has been described in connection with specific embodiments, it is to be understood that the disclosure is not limited to these embodiments, and that alterations, modifications, and variations of these embodiments may be carried out by the skilled person without departing from the scope of the disclosure.

It is furthermore contemplated that any part of any aspect or embodiment discussed in this specification can be implemented or combined with any part of any other aspect or embodiment discussed in this specification.

The invention claimed is:

1. A male garment comprising:

a body including a front portion, a rear panel interconnected to the front portion, and leg openings for a wearer's legs;

a resiliently elastic stretch panel attached to an interior of the body and comprising an opening for receiving therethrough the wearer's genitalia;

a pouch defined between the stretch panel and the front portion for receiving therein the wearer's genitalia; and a padded member attached to the interior of the body for cushioning one or more areas of the wearer, wherein the one or more areas include a buttocks of the wearer, wherein the front portion comprises a first panel and a second panel, wherein a space is defined between the first panel and the second panel, and wherein the padded member extends into the space defined between the front first panel and the second panel.

2. The male garment of claim 1, wherein the one or more areas of the wearer further includes a crotch of the wearer.

3. The male garment of claim 1, wherein the front portion comprises a dart seam to assist in defining the pouch.

4. The male garment of claim 3, wherein the padded member is attached to the dart seam.

5. The male garment of claim 1, wherein the padded member is shaped to resemble a shape of a bicycle saddle.

6. The male garment of claim 1, wherein the padded member comprises polyester.

7. The male garment of claim 1, wherein the padded member comprises an antimicrobial material.

8. The male garment of claim 1, wherein the padded member comprises a chamois.

9. The male garment of claim 1, wherein:

the body further comprises a gusset including a front gusset seam and a rear gusset seam; and the front portion and the stretch panel are attached to the gusset along the front gusset seam.

10. The male garment of claim 9, wherein the gusset comprises a mesh fabric for improving breathability of the garment.

11. The male garment of claim 9, wherein the padded member is attached to the stretch panel along the front gusset seam.

12. The male garment of claim 9, wherein:

the panel is interconnected to the front portion via the gusset; and the padded member is attached to an interior of the rear panel and extends over a portion of the rear panel and over a portion of the gusset.

13. The male garment of claim 1, wherein:

the stretch panel is attached to the front portion at top and bottom locations; and when unstretched, the stretch panel has a top-to-bottom length that is smaller than a distance separating the top and bottom locations as measured along the front portion.

14. The male garment of claim 13, wherein the bottom location is a portion of a front gusset seam of a gusset of the garment.

15. The male garment of claim 1, wherein:

the stretch panel is attached to the front portion at left and right locations; and when unstretched, the stretch panel has a left-to-right width that is smaller than a distance separating the left and right locations as measured along the front portion.

16. The male garment of claim 1, wherein the stretch panel comprises one or more fabrics with one or more asymmetric stretch characteristics such that the stretch panel stretches more easily in a top-to-bottom direction than in a left-to-right direction.

17. The male garment of claim 1, wherein the stretch panel comprises a fabric that is different from a fabric of the body.

18. The male garment of claim 1, wherein the stretch panel comprises a pair of top edges, each top edge having first and second ends, the first ends defining upper corners of the stretch panel, and wherein, when the stretch panel is unstretched, the top edges extend downwardly from the first ends to the second ends.

19. The male garment of claim 18, wherein the stretch panel is attached to the front portion along the top edges of the stretch panel such that, when attached to the front portion, the stretch panel is tensioned.

20. A method of making a male garment, the male garment comprising:

a body including a front portion, a rear panel interconnected to the front portion, and leg openings for a wearer's legs;

a resiliently elastic stretch panel attached to an interior of the body and comprising an opening for receiving therethrough the wearer's genitalia; and a pouch defined between the stretch panel and the front portion for receiving therein the wearer's genitalia, wherein the method comprises attaching a padded member to an interior of the body for cushioning one or more areas of the wearer, wherein the one or more areas include a buttocks of the wearer, wherein the front portion comprises a first panel and a second panel, wherein a space is defined between the first panel and the second panel, and wherein the padded member extends into the space defined between the first panel and the second panel.

21. The male garment of claim 1, wherein the space defined between the first panel and the second panel is enclosed by the first panel and the second panel.

22. The male garment of claim 1, wherein the second panel comprises a front-facing surface and a rear-facing surface, wherein the front-facing surface faces the first panel of the front portion, and wherein the rear-facing surface faces the rear panel.

23. A male garment comprising:

a body including a front portion, a rear portion interconnected to the front portion, and leg openings for a wearer's legs;

a resiliently elastic stretch panel attached to an interior of the body and comprising an opening for receiving therethrough the wearer's genitalia;

a pouch defined between the stretch panel and the front portion for receiving therein the wearer's genitalia; and a padded member attached to the interior of the body for cushioning one or more areas of the wearer, wherein the one or more areas include a buttocks of the wearer, wherein the front portion comprises a front panel and a rear panel, wherein the front panel and the rear panel face each other to define a space between the front panel and the rear panel, and wherein the padded member extends into the space defined between the front panel and the rear panel.

* * * * *